United States Patent [19]

Tabuchi

[11] Patent Number: 4,481,738

[45] Date of Patent: Nov. 13, 1984

[54] GRINDING MACHINE

[75] Inventor: Shūji Tabuchi, Yokohama, Japan

[73] Assignees: Fujitsu Limited, Kawasaki; Disco Abrasive Systems, Ltd., Tokyo, both of Japan

[21] Appl. No.: 529,670

[22] Filed: Sep. 6, 1983

Related U.S. Application Data

[63] Continuation of Ser. No. 257,472, Apr. 24, 1981, abandoned.

[30] Foreign Application Priority Data

Apr. 24, 1980 [JP] Japan ..... 55-54721

[51] Int. Cl.[3] ..... B24B 9/00

[52] U.S. Cl. ..... 51/5 R; 51/131.5; 51/134; 15/4

[58] Field of Search ..... 51/5 R, 131, 134; 15/4

[56] References Cited

U.S. PATENT DOCUMENTS

| | | | |
|---|---|---|---|
| 2,405,417 | 8/1946 | Fruth . | |
| 3,824,742 | 7/1974 | Rupp | 51/54 |
| 4,141,180 | 2/1979 | Gill, Jr. et al. | 51/5 R |
| 4,222,203 | 9/1980 | Wolf et al. | 51/54 |

FOREIGN PATENT DOCUMENTS

| | | |
|---|---|---|
| 615742 | 10/1926 | France . |
| 2070621 | 8/1971 | France . |
| 2083971 | 11/1971 | France . |

OTHER PUBLICATIONS

E. Mendel et al., "Removing Protuberances and Asperities", *IBM Technical Disclosure Bulletin,* vol. 13, No. 6, Nov. 1970, p. 1420.

*Primary Examiner*—E. R. Kazenske
*Assistant Examiner*—Willmon Fridie, Jr.
*Attorney, Agent, or Firm*—Staas & Halsey

[57] ABSTRACT

A grinding machine adapted for grinding surfaces of thin workpieces comprises a rotating table provided with at least a workpiece holder on which a workpiece to be ground is held, and a plurality of grinding wheels having different grain sizes ranging from coarse to fine, and rotating independently of each other. The wheels are disposed above the table and in arrangement so that, as the table rotates, the wheels grind successively the surface of the workpiece to provide a desired total thickness of grind and a reasonable surface finish through one rotation of the table.

11 Claims, 5 Drawing Figures

GRINDING MACHINE

This application is a continuation of application Ser. No. 257,472, filed Apr. 24, 1981 now abandoned.

BACKGROUND OF THE INVENTION

The present invention relates to a grinding machine and, more specifically, to a surface grinding machine adapted to grind a surface of a workpiece such as a semiconductor wafer having a very small thickness, for example, of several hundreds μm to 1 mm (1,000 μm).

In general, semiconductor devices are manufactured through the process of forming many elements on a thin plate which is called a semiconductor wafer, cutting the wafer into chips, and enclosing the chips with containers. In this manufacturing process, the wafer is the main object of handling. However, the wafer is made of, for example, a single crystal silicon that is brittle and is easily broken by handling in the manufacturing process. Moreover, with the progress of semiconductor technology, the outer diameter of the wafer tends to be increased in order to reduce the manufacturing cost by mass production and, at present, is as great as 4 inches or more. The greater the outer diameter of the wafer is, the more the wafer tends to be easily broken, and accordingly the wafer has to be maintained thick to a certain extent.

On the other hand, if a thick wafer is cut and manufactured into semiconductor devices, the conductivity of heat is poor and the electric characteristics are adversely affected. It is therefore necessary to adjust the thickness of the wafer by grinding the back surface of the wafer during the manufacturing process. Furthermore, in the process of forming the semiconductor elements on the wafer, the back surface of the wafer is formed with diffusion layers, as well as various layers of aluminium, polycrystalline silicon, silicon dioxide, phospho silicate glass and the like, which are achieved by deposition and heat treatment. However, the back surface of the wafer is as important to the semiconductor device as the side surface of the wafer, on which semiconductor elements are formed, from the viewpoint of taking-out electrodes, uniform heat radiation from the device, and so forth. Accordingly, even if there is no need to adjust the thickness, it is necessary to remove the layers as mentioned above. Furthermore, for easy soldering, i.e. mounting of the chip, it is required to finish the back surface of the wafer to a surface having a reasonable surface roughness.

For providing the above mentioned adjusting of the thickness and finishing of the surface, there has been used a method in which the back surface of the wafer is subjected to etching with chemicals. This method, however, requires a large quantity of chemicals, resulting in increased manufacturing cost. Furthermore, handling the chemicals is dangerous, and the disposal of the used chemicals is a troublesome problem from the viewpoint of environmental pollution.

Under these circumstances, grinding machines adapted for grinding a thin plate have been devised and used. In a conventional machine, however, there are various problems which will become apparent from the description set forth below.

A typical grinding machine known in the art is schematically illustrated in FIGS. 1 and 1A of the accompanying drawings, in which FIG. 1 is a plan view and FIG. 1A is a sectional view taking along line A—A in FIG. 1. In these Figures, the reference numeral 1 denotes a rotating table of about 800 mm in diameter, which rotates in the direction of the arrow "X". The table 1 is made of stainless steel and is provided with a plurality of workpiece holders 2 which are constructed by embedding porous ceramic plates in the table. Wafers 3 are placed on the holders 2 with the back surface up and are to be held in place by vacuum suction illustrated by the arrow "V" in FIG. 1A. Above the table 1 is disposed a grinding wheel 4, which is mounted on a spindle (not illustrated) and rotates at a speed of about 2,400 rpm in the direction of the arrow "X" and grinds successively the back surfaces of the wafers 3 by using diamond grains adhered onto the lower surface of the wheel 4. If the diamond grains have a grain size of 1,200 mesh, the wafer 3 is ground by a thickness of about 2 μm when the table rotates once. Therefore, in the case of grinding a thickness of 100 μm, for example, the table 1 has to be rotated 50 times, for which an operation time of over ten minutes usually required. Such a long time consuming grinding operation makes it difficult to provide an automatic manufacturing system for continuous mass production of semiconductor devices.

In the illustrated conventional machine, when the wafers 3 are removed from the table 1 after the completion of the grinding operation, the vacuum suction "V" is interrupted and, successively, air is injected to the holders 2, as illustrated by the dotted arrow "W" in FIG. 1A. The injected air serves to facilitate the removal of the wafer and, also, to clean away fine particles on the surfaces of the holders 2, that are produced by the grinding operation. In this case, because of the flatness of the table 1, it is required to clean the entire surface of the table 1. It is, however, difficult to clean completely the entire table surface having a large area. Accordingly, when a new wafer, that is to be ground in the next operation, is positioned on the holder 2, residual fine particles are sandwiched in between the holder 2 and the wafer and this causes microcracks on the surface of the wafer, i.e. the device side surface on which the semiconductor elements are formed. Consequently, the semiconductor elements are damaged. Moreover, there is also a risk that the wafers will be carried away together with the injected air toward the circumference of the table and will be superposed upon each other.

Furthermore, in a grinding machine of this sort, a preparatory operation, which is called a dressing operation, is frequently required to ensure a good degree of parallelism for the workpiece. The dressing operation is performed by grinding the surfaces of the workpiece holders 2 to provide a good degree of parallelism thereof. In the illustrated conventional machine, however, because of the evenness of the holders with the table, it is impossible to provide a good degree of parallelism of the holders, unless the table 1 is also ground simultaneously with grinding the holders 2. In this case, the grinding of the table 1 made of stainless steel requires the use of a grinding wheel adapted for stainless steel, which is different from a grinding wheel adapted for a wafer. Consequently, the dressing operation is complicated and inefficient. Moreover, unlike porous ceramics stainless steel has a large thermal expansion coefficient, that makes it difficult to provide a good degree of parallelism of the holders.

Furthermore, in the illustrated conventional machine, the holders 2 are embedded in the table 1 and are not exchangeable. Therefore, in order to adapt the machine to grind wafers having various diameters, it is required to prepare tables which are provided with holders having various diameters, and to exchange the tables according to the sizes of the wafer.

SUMMARY OF THE INVENTION

Accordingly, it is a primary object of the present invention to provide a new and improved grinding machine adapted to grind a thin workpiece, such as a semiconductor wafer, in which the aforementioned problems are eliminated.

A specific object of the present invention is to provide a grinding machine, which can prepare accurately a thin workpiece to a desired thickness and a reasonable surface finish, while maintaining a high rate of production in a continuous manner.

Another object of the present invention is to provide a grinding machine in which various preparatory operations, such as exchanging, washing and dressing of workpiece holders can be easily performed.

According to the present invention, there is provided a grinding machine which comprises a rotating table provided with at least a workpiece holder on which a workpiece to be ground is held, and a plurality of grinding wheels which have different grain sizes ranging from coarse to fine and which rotate independently of each other. The grinding wheels are disposed above the table and arranged so that, as the table rotates, the wheels grind successively the surface of the workpiece to provide a desired total thickness of grind and a reasonable surface finish through one rotation of the table. Therefore, the workpiece can be prepared to a desired thickness and a reasonable surface finish through one rotation of the table.

Preferably, the workpiece holder protrudes above the surface of the table. This construction facilitates simple preparatory operations of the machine for washing and dressing the workpiece holder. The workpiece holder is also preferably adapted to be removably mounted on the table.

The grinding machine preferably comprises washing means for washing the surface of the holder on which the workpiece is held. The washing means preferably comprises a water ejection system adapted to eject from the surface of the workpiece holder, and/or a washing brush adapted to rotate, while injecting water, to wash the surface of the workpiece holder.

BRIEF DESCRIPTION OF THE DRAWINGS

The present invention will become more apparent from the description of a preferred embodiment set forth below with reference to the accompanying drawings, in which.

DETAILED DESCRIPTION OF THE PREFERRED EMBODIMENTS

Figure 1:
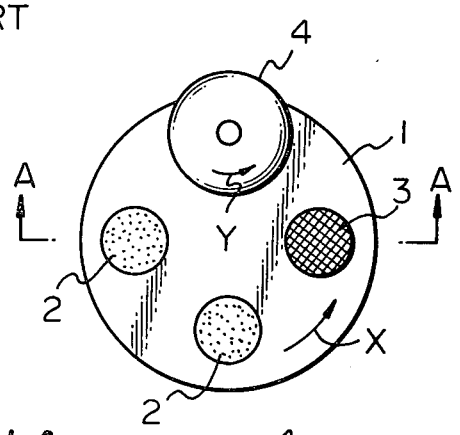
Fig. 1 PRIOR ART
FIGS. 1 and 1A illustrate a grinding machine known in the art, as described hereinbefore.
Figure 1A:
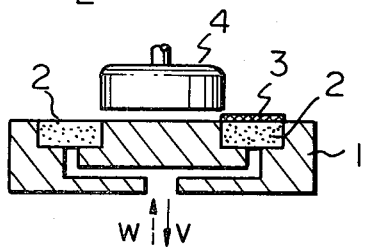
Fig. 1A PRIOR ART
Figure 2:
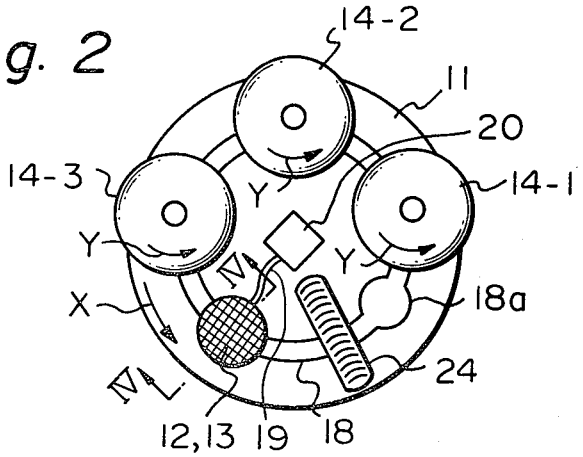
FIG. 2 is a schematic plan view of an embodiment of a grinding machine according to the present invention.
Figure 3:
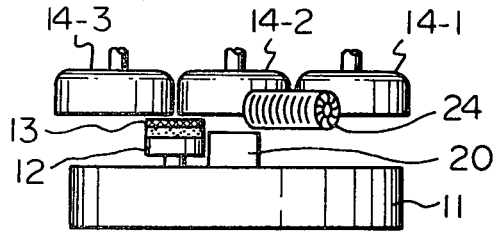
FIG. 3 is a schematic front elevational view of the embodiment illustrated in FIG. 2.

Referring to FIGS. 2 and 3, the illustrated grinding machine according to the present invention comprises a rotating table 11 which rotates in the direction of the arrow "X". The table 11 is provided with a workpiece holder 12, which will be described specifically hereinafter. The holder 12 protrudes above the upper surface of the table 11, and a semiconductor wafer 13, that is a workpiece, is placed on the top surface of the holder 12 and is held by means of vacuum suction. It should be noted that the holders 12 can be provided in large numbers on the table 11, although only one is illustrated for convenience of illustration. Above the table 11 are disposed three grinding wheels 14 (-1, -2, -3) which are mounted on a spindle (not illustrated) and rotate in the direction of the arrow "Y" independently of each other. The wheels 14 have different grain sizes ranging from coarse to fine and are arranged along the path of the wafer 13 turning with the rotation of the table 11. Accordingly, when the table 11 rotates once, the wafer 13 is ground by the wheels 14 successively to be prepared to a desired thickness and a reasonable surface finish, as will be described specifically hereinafter.

Figure 4:
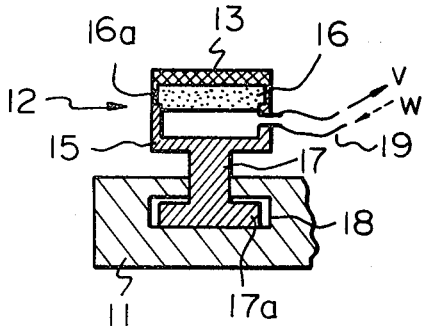
FIG. 4 is an enlarged sectional view taken along line IV—IV in FIG. 2, illustrating in particular a workpiece holder.

Referring to FIG. 4, the workpiece holder 12 has a cup-shaped body 15, to which is secured a top plate 16 that closes the top opening of the body 15. The top plate 16 is made of porous ceramic, and its peripheral portion 16*a* is impregnated with a synthetic resin for sealing. The body 15 is supported by a leg 17 having a round base 17*a*, which is detachably fitted into a circular slot 18 of a T-shape cross section formed in the table 11 and is secured to the table 11 by suitable means, such as a bolt, not illustrated in the drawings. The holder 12 can be mounted on, and dismounted from, the table 11, by causing the leg 17 to engage and disengage the slot 18 via a round opening 18*a* (refer to FIG. 2). To the side of the body 15 is connected a tube 19, through which the interior of the body 15 is in communication with a vacuum suction head 20 (refer to FIGS. 2 and 3). Although not illustrated, the head 20 is connected, via a mechanical control valve, to a water-sealed vacuum pump and a water supply line, thereby selectively providing the holder 12 with vacuum suction illustrated by the arrow "V" and with water illustrated by the dotted arrow "W". The changeover of the vacuum suction and the water is effected by operating said control valve. The wafer 13 is placed on the top plate 16 of the holder 12, with the back surface up, i.e. with the device side surface formed with the semiconductor elements down, and is adsorbed the top plate 16 by the vacuum suction "V". When the wafer 13 is removed from the holder 12, the vacuum suction "V" is interrupted, and successively the water "W" is injected from tube 19 through the top plate 16 of the holder 12 so as to facilitate the removal of the wafer and to wash the top plate 16 of the holder 12.

Figure 5:
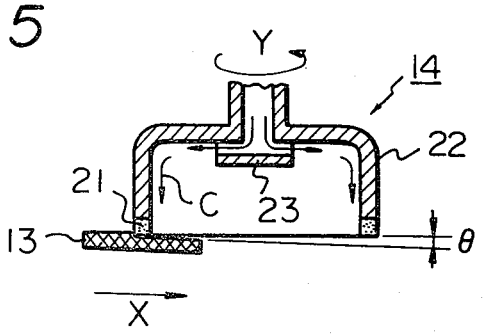
FIG. 5 is an enlarged sectional view illustrating in particular a grinding wheel in operation.

Referring to FIG. 5, the grinding wheel 14 has a ring-shaped grindstone 21 which is attached to a lower circular surface of a cup-shaped substrate 22. The grindstone 21 is made up of metal-bonded abrassive grains, such as diamond grains, having a uniform grain size. The wheels 14 have different grain sizes ranging from coarse to fine. For example, the wheels 14-1, 14-2 and 14-3 have grain sizes of 320 mesh, 600 mesh and 1,700 mesh, respectively. All of these wheels 14 rotate at a speed of 4,000 to 10,000 rpm. The wheel 14 is arranged in a slightly tilted position, so that the grindstone 21 touches the wafer 13 at an angle of $\theta$, for example 1° to 2°, and grinds the wafer by using the outer peripheral edge thereof. The wheel 14 also can be adjusted so as to vary the vertical distance between the holder 12 and the wheel 14, whereby the thickness to be ground through a one time grinding operation can be adjusted. Furthermore, the wheel 14 is provided with a nozzle 23 within the substrate 22, to inject cooling water illustrated by the arrow C, which flows along the inner surface of the substrate 22 onto the wafer 13, thereby taking the frictional heat caused by the grinding out of the wafer.

In operation, as the table 11 rotates, the grinding wheels 14 grind successively the back surface of the wafer 13 to provide a desired total thickness of grind and a reasonable surface finish. The wheels 14-1 and 14-2 having coarse and middle grain sizes perform rough and moderate grindings to provide a large thickness of grind and, on the other hand, the wheel 14-3 having a fine grain size perform a fine grinding to provide a small thickness of grind and a reasonable surface finish. For example, in the case wherein 100 μm of the wafer 13 is to be ground, the wheels 14-1, 14-2 and 14-3 are adapted to grind thicknesses of 70 μm, 20 μm and 10 μm, respectively, and accordingly the total thickness of 100 μm can be ground accurately when the table 11 rotates once. At the same time, the back surface of the wafer 13 can be prepared to a fine surface finish by the fine wheel 14-3 having a fine grain size.

For the purpose of finishing the wafer through one rotation of the table, the wheels 14 are rotated faster than in the conventional machine, and on the other hand the table 11 is rotated slower than in the illustrated conventional machine, for example, at a speed of 100 to 200 mm per minute along the path of the wafer 13.

In the manner described above, the wafer can be finished through one rotation of the table. If the table is provided with a plurality of workpiece holders, as the table rotates, the wafers can be finished in a short interval of time, for example about one minute. This manner of operation makes it easy to provide the grinding machine with mechanisms for successively mounting and dismounting the wafers onto and from the table, and in turn makes it possible to provide an automatic manufacturing system for continuous of semiconductor wafers production.

With the machine of the present invention, the wafer can be finished with a high accuracy. For example, in the case wherein a wafer of 4 inches in diameter was ground from a thickness of 700 μm to a thickness of 500 μm, the variance in thickness was ±20 μm when the illustrated conventional machine was used and, on the other hand, 35 5 μm when the above described machine of the present invention was used.

Moreover, in the case wherein the thickness to be ground through a one time grinding operation is made large, as in the present invention, the wafer tends to become warped, resulting in interference with the manufacturing process such as the patterning of semiconductor elements. However, there is no warping in the wafer grounded by using the above described machine of the present invention. For this reason, it was found through experiments that the extent of the warp after the grinding depends upon the grain size of the grinding wheel irrespective of the thickness of grind, and also the extent of the warp increases with the increase in grain size and decreases remarkably when the grain size becomes smaller than a predetermined value, i.e. 1,000 mesh or more. Namely, when the grain size is larger than 1,000 mesh the extent of the warp is 100 to 1,000 μm, and when the grain size is smaller than 1,000 mesh, the extent of the warp is 10 to 50 μm. In the above mentioned machine of the present invention, the finished wafer has almost no warp because it is finished by the wheel 14-3 having a fine grain size of 1,700 mesh.

Another important feature resides in the construction of the workpiece holder 12. As described hereinbefore, when the wafer 13 is removed from tube 19 through the holder 12 after the completion of the grinding, water is injected from the top plate 16 of the holder 12 to facilitate the removal of the wafer 13 and to wash away fine particles on the top plate 16. In this case, the washing of the top plate 16 can be very easily and effectively performed, because the holder 12 protrudes above the surface of the table 11 and the washing thereof needs to be performed only for the small surface of the top plate 16.

Similarly, because of the protrusion of the holder 12, the dressing of the holder 12 can be performed very simply and accurately. Therefore, the dressing needs to be effected only for the top plate 16 of the holder 12, made of a porous ceramic, and accordingly the dressing can be performed sufficiently by using the grinding wheels 14 adapted for grinding the wafer 13. This matter provides a highly precise parallelism and a reduction in the number of dressing steps.

Furthermore, the holder 12 is exchangeable as described hereinbefore. Accordingly, it is possible to adapt the machine to grind wafers having various diameters, by preparing holders having various diameters and by exchanging the holders according to the diameter of the wafer to be ground. Therefore, a preparatory operation can be carried out very efficiently, as compared with the illustrated conventional machine in which the tables have to be exchanged.

As described hereinbefore, the washing of the holder 12 after the removal of the finished wafer can be effectively performed by ejecting water from the holder 12. The described machine of the present invention, however, further comprises a rotary washing brush 24 which is disposed above the table 11 and in the middle of the path of the holder 12 (refer to FIGS. 2 and 3). When the machine is grinding, the brush 24 rotates in its position, while water is ejected from the brush 24 and the holder 12, to more positively wash the top plate 16 of the holder 12. Accordingly, a new wafer to be ground is mounted on the holder 12 after fine particles caused by the prior grinding operation have been completely washed away. Therefore, no microcracks are caused in the wafer.

As can be understood from the above, the present invention provides a grinding machine, which has many advantages or merits as mentioned above and, accordingly, can contribute greatly to the development of semiconductor devices, or the like.

It should be appreciated that the description set forth above has dealt with the case wherein the workpiece to be ground is a semiconductor wafer, but the present invention should not be limited to the above example only and can be adapted to any other workpieces without departing from the spirit and scope of the invention.

The present invention has been described in detail with particular reference to a preferred embodiment thereof, but it will be understood that variations and modifications can be effected without changing the basic scope of the invention.

I claim:

1. A grinding machine for grinding a surface of a thin plate-like workpiece, comprising:

a rotating table provided with at least a workpiece holder including a cup-shaped body being secured to the table and having a hollow interior portion, and a top plate attached to said body and closing the top opening of said body, said top plate being made of porous material and having a top flat surface on which the workpiece is placed and held, the holder being detachably and non-rotatably secured to the table with said top surface protruding above the table surface;

vacuum means having a suction end member connected to and communicating with the interior hollow portion of the cup-shaped body for providing said workpiece holder with vacuum suction for holding the workpiece to the workpiece holder; and a plurality of cup-shaped grinding wheels having different grain sizes ranging from coarse to fine with a first grinding wheel having a grain size of less than 1,000 mesh and a final grinding wheel having a grain size of more than 1,000 mesh, each of the grinding wheels being rotated about an axis inclined at a slight angle to the axis of rotation of the table, the grinding wheels being disposed above the table in a circular arrangement with respect to the axis of rotation of the table and located in different axial positions with respect to the axis of rotation of the table, wherein, as the table rotates, the surface of the workpiece held to the workpiece holder is successively ground by the first grinding wheel to the last grinding wheel so that a desired total thickness is ground and a desired surface finish is obtained in one rotation of the table.

2. A grinding machine according to claim 1, wherein the workpiece holder further comprises a support member for supporting said body removably secured to the table.

3. A grinding machine according to claim 1, further comprises washing means for washing the surface of the holder on which the workpiece is held.

4. A grinding machine according to claim 3, wherein said washing means comprises a water ejection system adapted to eject water from the surface of the workpiece holder.

5. A grinding machine according to claim 3, wherein said washing means comprises a washing brush disposed above the table and on the middle of the path of the workpiece holder turning with the table said washing brush being adapted to rotate, while ejecting water to wash the surface of the workpiece holder.

6. A grinding machine according to claim 3, wherein said washing means comprises: a water ejection system adapted to eject water from the surface of the workpiece holder, and a washing brush disposed above the table and on the middle of the path of the workpiece holder turning with the table, said washing brush being adapted to rotate, while ejecting water, to wash the surface of the workpiece holder.

7. The grinding machine of claim 1, wherein each of said grinding wheels has a ring-shaped grindstone attached to the lower circular surface of said grinding wheel cup-shaped body.

8. The grinding machine of claim 1, wherin said wheels are adjustable to vary the distance between the holders and the wheels, whereby the desired total thickness to be ground through one rotation of the table can be further regulated.

9. A grinding machine according to claim 1, wherein said at least a workpiece holder comprises a plurality of holders for holding workpieces positioned in a circular arrangement with respect to the axis of rotation of the table.

10. A grinding machine according to claim 1, wherein said grinding wheels are independently rotatable with respect to each other.

11. A grinding machine according to claim 9, wherein said grinding wheels are independently rotatable with respect to each other.

* * * * *

UNITED STATES PATENT AND TRADEMARK OFFICE

CERTIFICATE OF CORRECTION

PATENT NO. : 4,481,738

DATED : Nov. 13, 1984

INVENTOR(S) : Shūji-Tabuchi

It is certified that error appears in the above-identified patent and that said Letters Patent is hereby corrected as shown below:

Front page, [75] Inventor: "Shūji Tabuchi" should be --Shūji-Tabuchi--;

Column 1, line 10, after "workpiece" insert --,--;
Column 1, line 11, after "wafer" insert --,--;
Column 2, line 12, "X" should be --Y--;
Column 2, line 20, delete "time";
Column 2, line 21, delete "consuming".
Column 3, line 49, "injecting" should be --ejecting--.
Column 4, line 17, after "not" insert --fully--;
Column 4, line 52, "absorbed" should be --held in place on--;
Column 4, line 62, "abrassive" should be --abrasive--.
Column 5, line 29, "fine" (first occurrence) should be --final--;
Column 5, line 45, "of semiconductor wafers" should be --mass production of semiconductor wafers--;
Column 5, line 46, delete "production";
Column 5, line 53, "35" should be --±--.
Column 6, line 10, delete "tube 19 through";
Column 6, line 12, "injected" should be --ejected--;
Column 6, line 12, after "from" insert --tube 19 through--.
Column 8, line 11, after "table" insert --,--;
Column 8, line 26, "wherin" should be --wherein--.

Signed and Sealed this

*Sixteenth* Day of *July 1985*

[SEAL]

*Attest:*

DONALD J. QUIGG

*Attesting Officer* *Acting Commissioner of Patents and Trademarks*